US010918187B2

(12) United States Patent
Pires et al.

(10) Patent No.: US 10,918,187 B2
(45) Date of Patent: Feb. 16, 2021

(54) COSMETIC CASE

(71) Applicant: ZEN DESIGN SOLUTIONS LIMITED, Kowloon (HK)

(72) Inventors: Leo Clifford Pires, Basking Ridge, NJ (US); Roger Hwang, Maple (CA); Manisha Kohli, New Delhi (IN); Rahul Bose, New Delhi (IN)

(73) Assignee: ZEN DESIGN SOLUTIONS LIMITED, Kowloon (HK)

( * ) Notice: Subject to any disclaimer, the term of this patent is extended or adjusted under 35 U.S.C. 154(b) by 646 days.

(21) Appl. No.: 15/649,973

(22) Filed: Jul. 14, 2017

(65) Prior Publication Data

US 2018/0020804 A1 Jan. 25, 2018

(30) Foreign Application Priority Data

Jul. 20, 2016 (IN) ..... 201611024791

(51) Int. Cl.
*A45D 33/00* (2006.01)
*A45D 33/02* (2006.01)

(52) U.S. Cl.
CPC ..... *A45D 33/006* (2013.01); *A45D 33/025* (2013.01); *A45D 2200/05* (2013.01)

(58) Field of Classification Search
CPC .... A45D 33/025; A45D 33/02; A45D 33/003; A45D 33/006; A45D 2200/05
USPC ..... 132/307, 306, 298, 293, 294, 300; 66/169 R, 171, 172 E, 178 R, 178 A, 202; 442/304, 306, 316, 317
See application file for complete search history.

(56) References Cited

U.S. PATENT DOCUMENTS

| | | | | |
|---|---|---|---|---|
| 5,107,871 | A | 4/1992 | Butcher et al. | |
| 5,694,645 | A * | 12/1997 | Triplette | A41D 13/0015 2/102 |
| 5,981,066 | A * | 11/1999 | Gabbay | A47G 9/0238 428/389 |
| 6,047,710 | A * | 4/2000 | Irving | A45C 13/008 132/293 |
| 8,807,147 | B2 * | 8/2014 | Kim | A45D 33/006 132/293 |
| 2006/0260627 | A1 * | 11/2006 | Park | A41G 3/00 132/54 |
| 2010/0166832 | A1 * | 7/2010 | Ingle | A47G 9/007 424/443 |
| 2010/0275344 | A1 * | 11/2010 | Demarest | A41F 9/025 2/237 |
| 2011/0167547 | A1 * | 7/2011 | Jain | B32B 3/28 2/457 |
| 2013/0113057 | A1 * | 5/2013 | Taylor | G01L 1/18 257/417 |

(Continued)

FOREIGN PATENT DOCUMENTS

| | | | | |
|---|---|---|---|---|
| KR | 10-1248345 B1 * | 4/2013 | | A45D 33/24 |
| WO | WO-2015026092 A1 * | 2/2015 | | A45D 33/24 |
| WO | WO-2016153308 A1 * | 9/2016 | | A45D 33/006 |

*Primary Examiner* — Nicholas D Lucchesi
(74) *Attorney, Agent, or Firm* — Patterson + Sheridan, LLP

(57) ABSTRACT

The present disclosure relates to a cosmetic case, including: a cover, a base assembly, an applicator and a mesh screen having anti-microbial properties. Preferably, the mesh screen comprises silver plated knitted fabric which provides anti-microbial properties. The base assembly comprises an applicator holder, a mesh holder and a pan holder.

20 Claims, 6 Drawing Sheets

(56) References Cited

U.S. PATENT DOCUMENTS

| | | | | |
|---|---|---|---|---|
| 2013/0260628 | A1* | 10/2013 | Woods, II | D03D 15/08<br>442/184 |
| 2016/0235184 | A1* | 8/2016 | Lee | A45D 33/006 |
| 2016/0255939 | A1* | 9/2016 | Seo | A45D 33/006 |
| 2018/0049534 | A1* | 2/2018 | Kim | A45D 33/006 |

* cited by examiner

COSMETIC CASE

CROSS-REFERENCE TO RELATED APPLICATION

This application claims benefit of Indian Provisional Application Ser. No. 201611024791, filed on Jul. 20, 2016, which is incorporated by reference in its entirety.

BACKGROUND

Field of the Invention

The present disclosure relates to a cosmetic case with a mesh having antimicrobial, particularly antibacterial properties.

Description of the Related Art

In general, cosmetics may be divided into fundamental cosmetics such as skin toners, lotions and the like, make-up cosmetics such as powders, compacts and the like, and functional cosmetics for prevention of wrinkles and aging, and their contents are in the form of viscous liquid, solid, powder or gel.

Such cosmetics are stored in a case made of material such as plastics, vinyl, synthetic resin, metal, ceramics or the like.

Generally, these cosmetic cases contain a base compartment which holds the cosmetic and a cover compartment hinged to the base which provides for movement of the cover between an open and closed position. It is also well known in the art to use fine mesh screens to cover the cosmetic in the cosmetic case. Particularly, if the cosmetic is face powder, such screens allow for an even application of powder to the powder puff and prevent spillage or blowing of the powder. In these cosmetic cases, the applicator used with the cosmetic is either stored separately or just above the fine mesh screen within the cosmetic case. However, during course of time as the applicator is used repeatedly on user's skin, oil and dirt from the skin of the user contaminates the applicator which in turn contaminates the mesh screen resulting in growth of micro-organisms like bacteria onto the mesh screen.

Thus, it is an object of the present disclosure to provide a mesh screen in the cosmetic cases which possesses anti-microbial properties and which inhibit or reduce the growth of micro-organisms like bacteria.

SUMMARY

To achieve the above object, according to an aspect of the disclosure, there is provided a cosmetic case, the cosmetic case comprising a mesh screen made from a fabric which possesses antimicrobial properties. Preferably, the mesh screen comprises silver plated knitted fabric. The fabric comprises a mixture of polyamide and a polymer containing polyurethane for e.g. dorlastan or any other known material.

According to an embodiment of the present disclosure, there is provided a cosmetic case including: a cover comprising an outer cover and an inner cover, a base assembly, an applicator and a mesh screen having anti-microbial properties, preferably antibacterial properties.

According to an embodiment of the present disclosure, the base assembly comprises an applicator holder, a sub assembly holding the mesh screen and a pan holder. The cover is removably or non-removably connected to the applicator holder of the base assembly.

The pan holder holding a cosmetic pan is connected to the sub assembly holding the mesh screen in such a way that a cosmetic stored in the cosmetic pan can be dispensed through the mesh screen by application of pressure on the mesh screen. The screen covered cosmetic pan is suitable for use with powders, rouges, but particularly with heavy liquid, oil or paste-type compositions such as foundation make-ups, rouge, concealer, eye color, etc. The fine mesh screen enables controlled application of cosmetic to the applicator thus protecting against waste. The mesh screen is of such a consistency that it may be easily depressed with pressure thus following the decreasing levels of the cosmetic stored in the pan as it is used up. The mesh screen is made from a fabric which possesses antimicrobial properties. Preferably, the mesh screen comprises silver plated knitted fabric. The fabric may comprise a mixture of polyamide yarn and a polyurethane yarn. The polyurethane yarn may be selected from a group consisting of dorlastan, lycra, spandex, and elastin (e.g., polyether-polyurea copolymer). The polyamide yarn is selected from a group consisting of elastil, nylon, kevlar, and poliamid. Preferably, the fabric comprises a mixture of 85-94% polyamide yarn and 5-15% dorlastan. More preferably, the fabric comprises a mixture of 94% polyamide yarn and 6% dorlastan. The coating of silver provides antimicrobial, particularly antibacterial properties which reduces or prevents growth of microbes, particularly bacteria on the mesh screen.

The outer cover comprises a top wall and a side wall, the side wall has a connecting feature in form of interengageable threads on its inner surface. The connecting feature may also be selected from a group consisting of snap fit, friction fit and the like.

The inner cover comprising a top wall and a side wall. The side wall of the inner cover can be connected to the side wall of the outer cover by a connecting feature selected from a group consisting of threaded engagement, snap fit, friction fit and the like.

The applicator holder comprises a side wall having cylindrical shape and forming a housing having an open top end and an open bottom end. It would be within the scope of present disclosure, if the side wall is of any other shape selected from a group consisting of non-circular, oval, polygonal shapes and the like. The side wall comprises an upper portion and a lower portion. The upper portion is step back from the lower portion, thus forming a shoulder between the upper portion and the lower portion. Further, the upper portion has a connecting feature in form of interengageable threads on its outer surface for removably connecting to the interengageable threads present on the inner surface of the side wall of the outer cover. The connecting feature may also be selected from a group consisting of snap fit, friction fit and the like. Further, the upper portion of the side wall has a projection in form of an annular platform on its inner surface proximate to its top end. The annular platform forms a support for the applicator. According to other embodiments, the platform may be in form of discontinuous support structures radiating from the inner surface of the upper portion of the side wall or any other structure which provides support to the applicator.

According to present embodiment, in closed position of the cosmetic case, when the cover is connected to the applicator holder, a bottom periphery of the side wall of the inner cover is in contact with a top periphery of the upper portion of the side wall of the applicator holder providing an airtight seal to the cosmetic case.

Further, in closed position of the cosmetic case, when the cover is connected to the applicator holder, a bottom periphery of the side wall of the outer cover is in close proximity with a top periphery/shoulder of the lower portion of the side wall of the applicator holder.

The sub-assembly for holding the mesh screen is present between the applicator holder and the pan holder. The sub-assembly comprises a mesh holder, the mesh and a stopper. The mesh holder comprises a side wall cylindrical in shape and forming a housing having an open top end and an open bottom end. Further, it would be within the scope of present disclosure if the side wall is of any other shape selected from a group consisting of non-circular, oval, polygonal shapes and the like. The side wall comprises an upper portion and a lower portion such that the upper portion is a step back from the lower portion, thus forming a shoulder between the upper portion and the lower portion. The mesh screen is placed on a top peripheral surface of the upper portion of the side wall such that the mesh screen closes the open top end of the housing and a portion of the mesh screen hangs from the top end of the housing on the outer surface of the upper portion of the side wall. In other words, a portion of the upper portion of the side wall of the mesh holder is encased by the mesh screen. The stopper is arranged on the outer surface of the upper portion such that the portion of the mesh screen hanging from the top end of the side wall is held tight enough between the stopper and the upper portion of the side wall of the mesh holder, so that the mesh screen does not disengage from the mesh holder on application of pressure by user. According to an embodiment, the stopper is snap fitted on the outer surface of the upper portion of the side wall of the mesh holder by means of protrusions present on an inner surface of the stopper which engages with corresponding grooves on the outer surface of the upper portion of the side wall of the mesh holder. According to other embodiments, the stopper can be connected to the mesh holder by other engagement means selected from a group consisting of threaded engagement, friction fit and the like. Further, a lower surface of the annular projection of the applicator holder has at least one teeth extending in downward direction and the top peripheral surface of the upper portion of the side wall of the mesh holder has at least one teeth extending in upward direction to further lock the mesh screen between the mesh holder and the applicator holder.

The sub assembly is connected to the applicator holder by suitable engagement means selected from a group consisting of threaded engagement, snap fit, friction fit and the like. According to the present embodiment, the mesh holder is snap fitted to the applicator holder. The mesh holder has a projection on the outer surface of lower portion of the side wall which engages with a corresponding groove on an inner surface of the lower portion of the side wall of the applicator holder.

The pan holder holding the cosmetic pan is received inside the housing of the sub assembly and is connected to the sub assembly holding the mesh screen by suitable engagement means selected from a group consisting of threaded engagement, snap fit, friction fit and the like. According to an embodiment, the pan holder comprises a side wall and a bottom wall. A lower portion of the side wall of the pan holder comprises a projection on its outer surface which engages with a corresponding groove present on inner surface of lower portion of the side wall of the mesh holder. The cosmetic pan is generally made of a metal material such as aluminum or plastic or any other material known in art.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
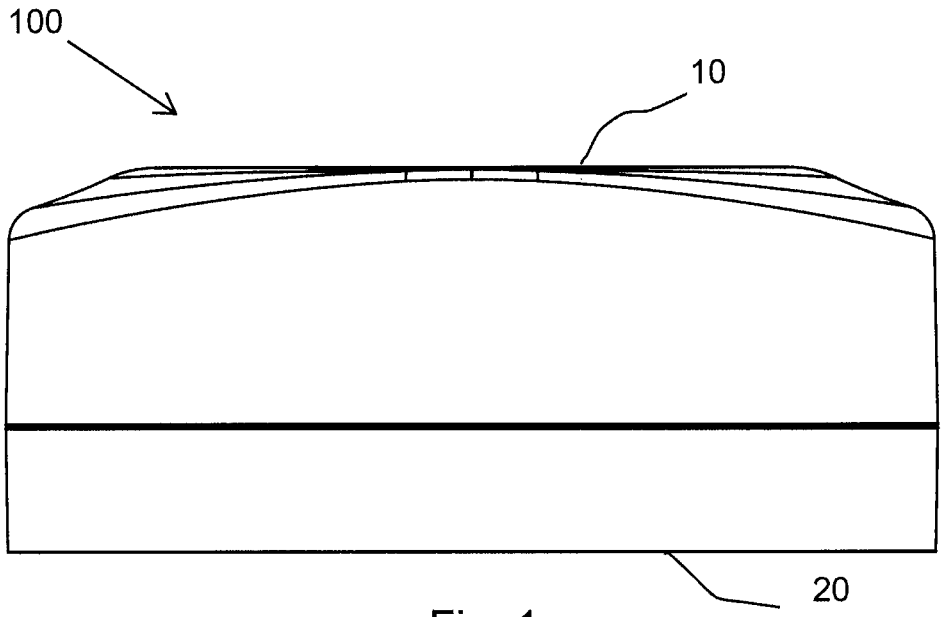
FIG. 1 illustrates a front view of a cosmetic case in a closed state according to one embodiment of present disclosure.
Figure 2:
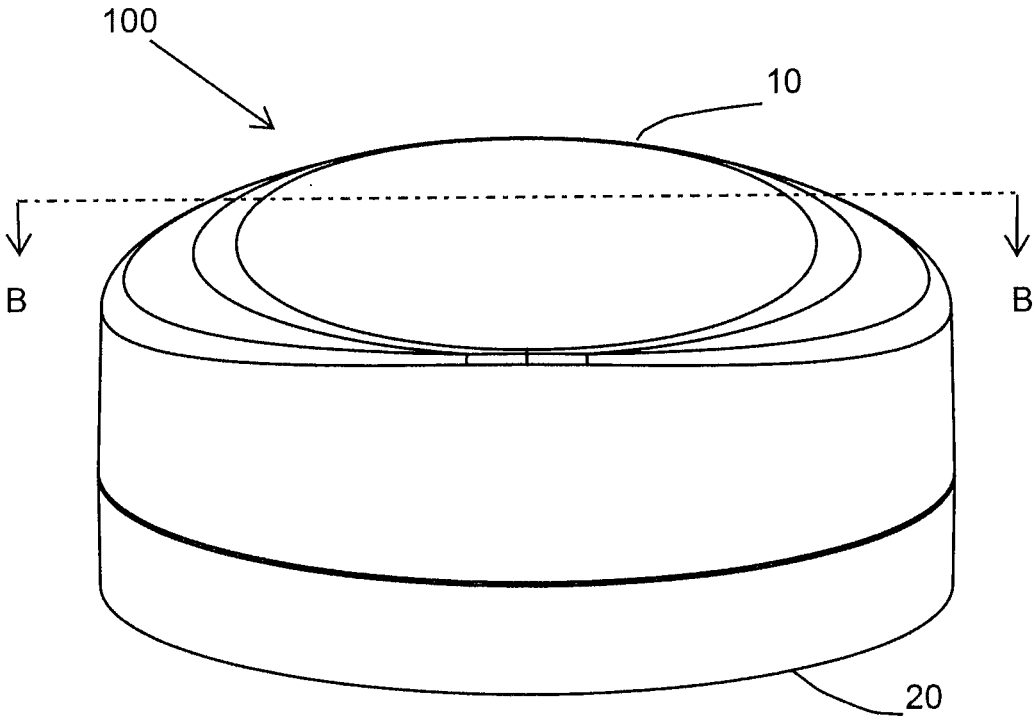
FIG. 2 illustrates a perspective view of the cosmetic case of FIG. 1.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

FIGS. 1 through 7 show a cosmetic case 100, including: a cover 10 comprising an outer cover 13 and an inner cover 15, a base assembly 20, an applicator 30 and a mesh screen 40 having anti-microbial properties.

Figure 4:
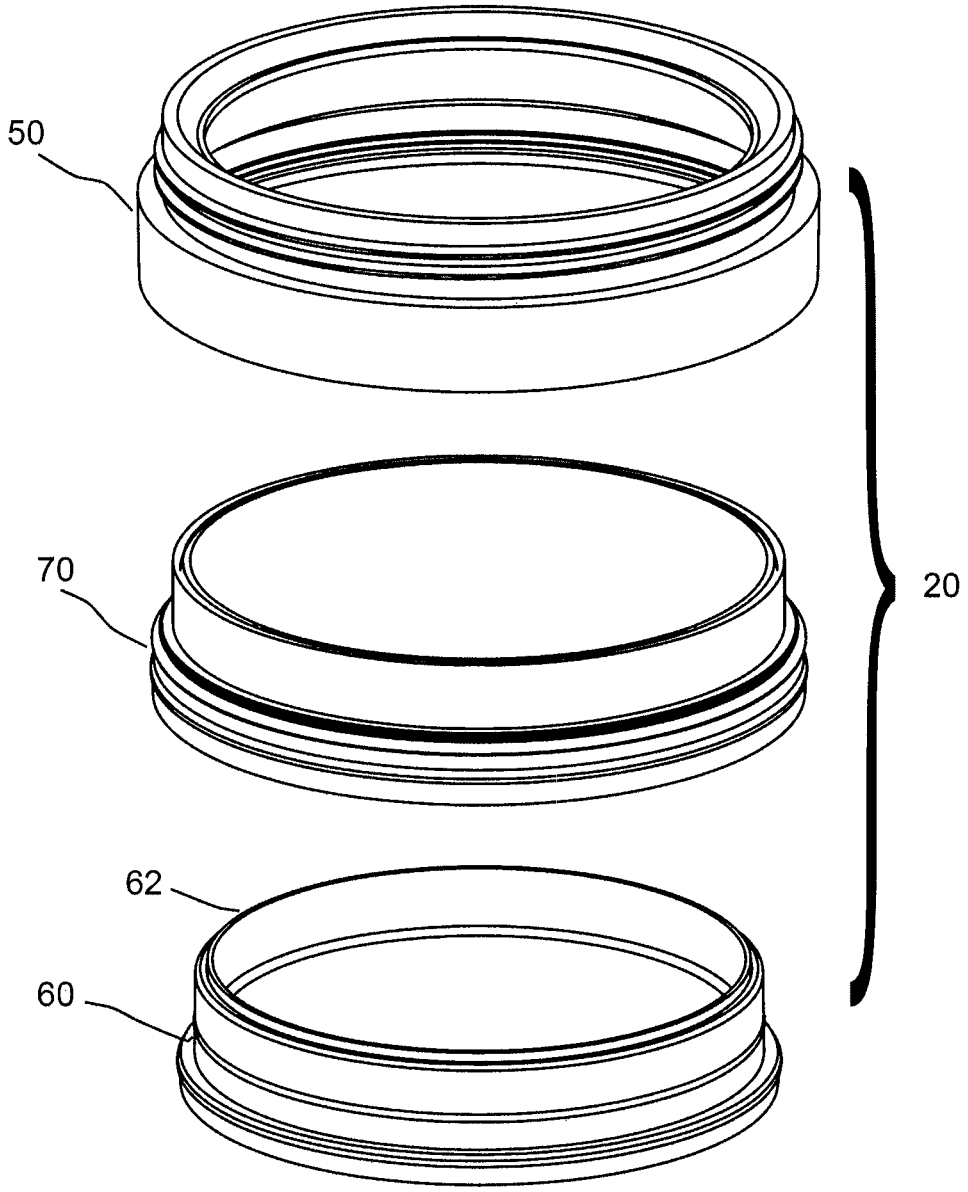
FIG. 4 illustrates an exploded view of a base assembly of the cosmetic case of FIG. 3, showing different components of the base assembly.
Figure 5:
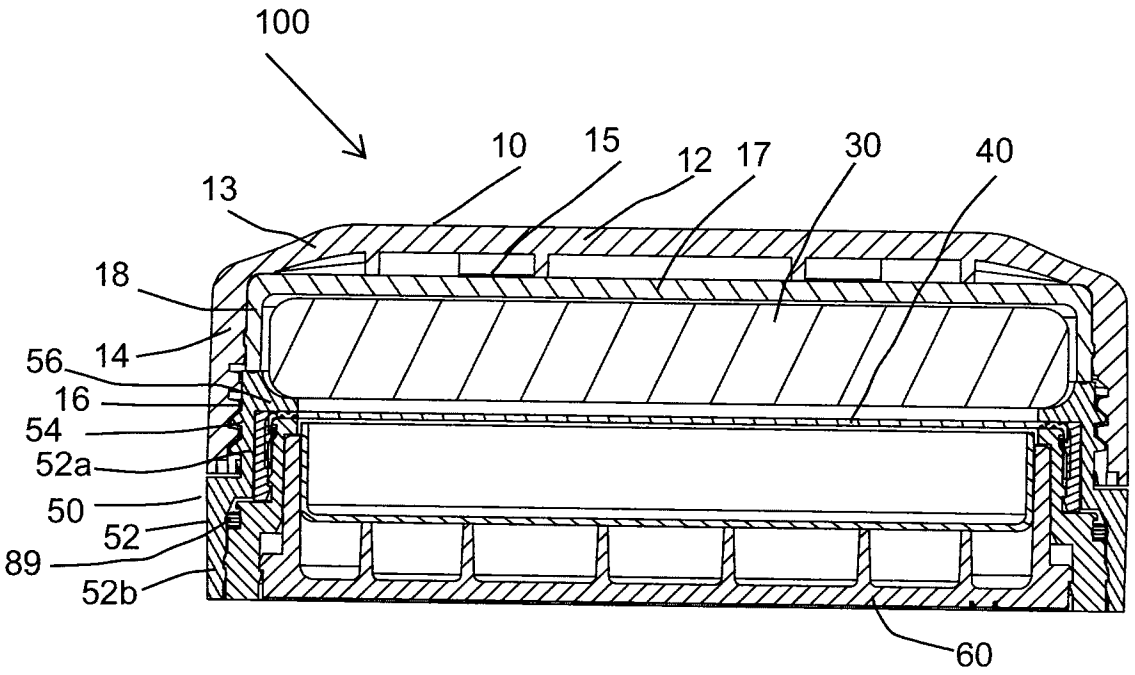
FIG. 5 illustrates a cross-sectional view along an axis B-B of the cosmetic case of FIG. 2.
Figure 6:
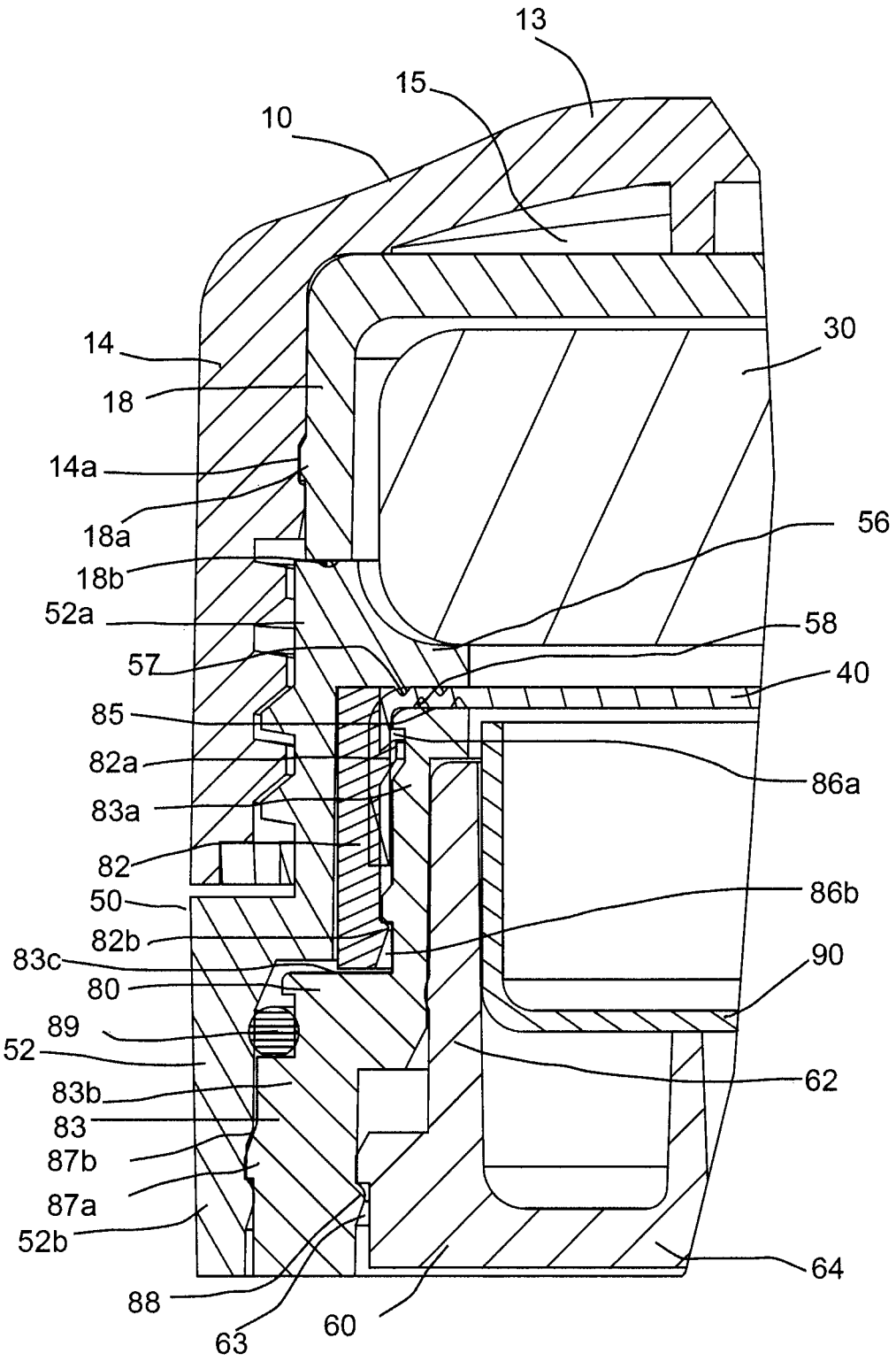
FIG. 6 illustrates an enlarged view of a portion of the cross-sectional view of the cosmetic case shown in FIG. 5.

According to an embodiment of the present disclosure and as shown in FIGS. 4-6, the base assembly 20 comprises an applicator holder 50, a sub assembly 70 for holding the mesh screen 40 and a pan holder 60.

As shown in FIG. 5, the outer cover 13 is removably connected to the applicator holder 50 of the base assembly 20. The outer cover 13 comprises a top wall 12 and a side wall 14, the side wall 14 has a connecting feature in form of interengageable threads 16 on its inner surface. The connecting feature may also be selected from a group consisting of snap fit, friction fit and the like. The outer cover 13 in general, may be made of a clear or colored thermoplastic material such as polypropylene, but any other thermoplastic would work, i.e. ABS, styrene acrylonitrile, styrene etc. would be suitable. According to alternate embodiment, the outer cover 13 may be non-removably connected to the base assembly 20 for e.g. by a hinge connection.

The inner cover 15 comprises a top wall 17 and a side wall 18. The side wall 18 of the inner cover 15 can be connected to the side wall 14 of the outer cover 13 by a connecting feature selected from a group consisting of threaded engagement, snap fit, friction fit and the like. According to present disclosure, as shown in FIG. 6, the side wall 18 of the inner cover 15 comprises an annular projection **18*a* which is engaged in an annular groove 14*a* present on an inner surface of the sidewall 14 of the outer cover 13**.

Figure 3:
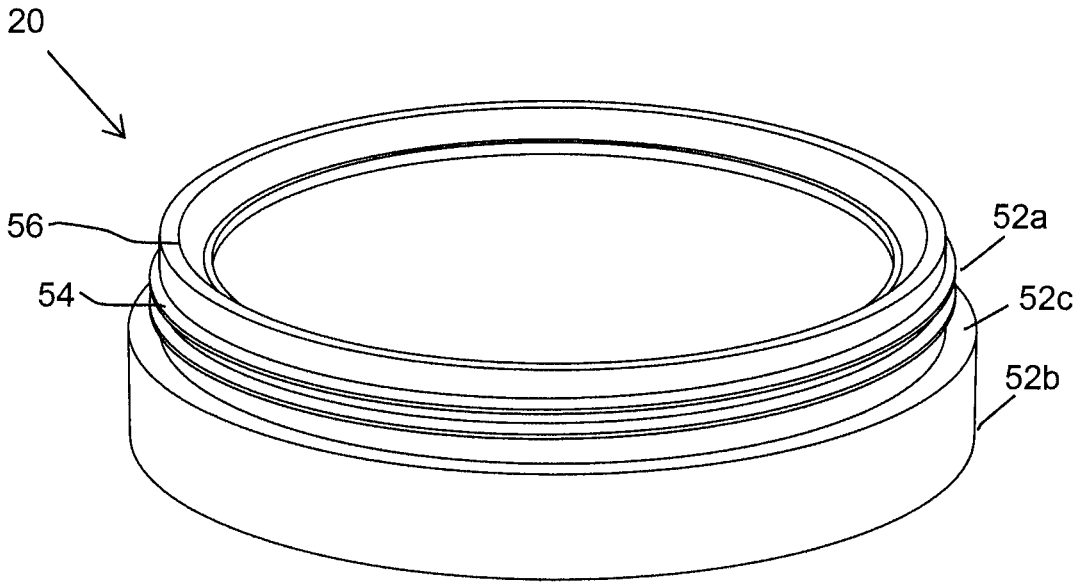
FIG. 3 illustrates an open view of the cosmetic case of FIG. 2 with a cover and an applicator removed.
Figure 7:
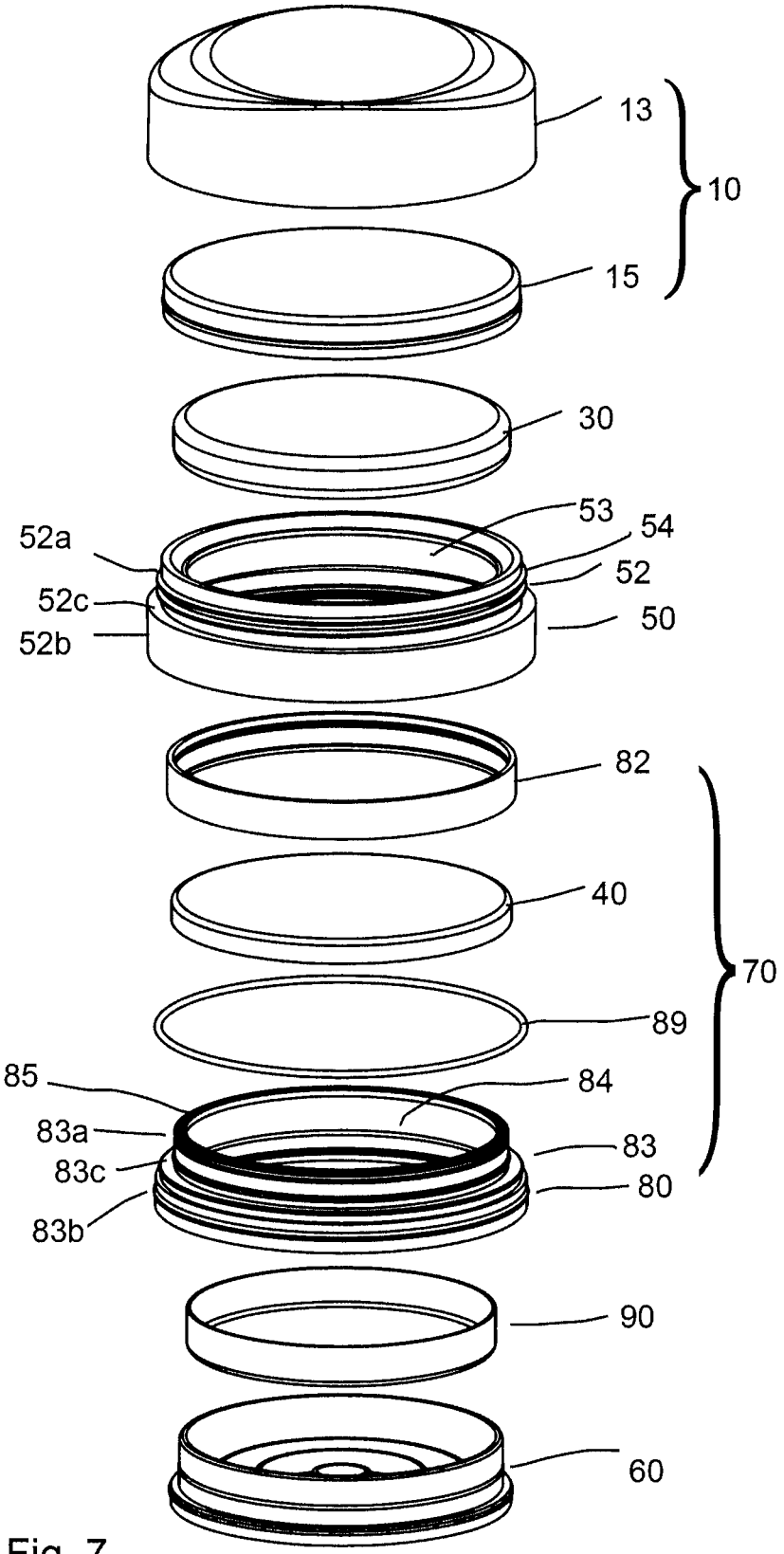
FIG. 7 illustrates an exploded view of the cosmetic case of FIG. 2.

Referring to FIGS. 3, 5 and 7, the applicator holder 50 comprises a side wall 52 cylindrical in shape and forming a housing 53 having an open top end and an open bottom end. The side wall 52 comprises an upper portion 52*a* and a lower portion 52*b*. The upper portion 52*a* is a step back from the lower portion 52*b* forming a shoulder 52*c*. Further, the upper portion 52*a* has a connecting feature in form of interengageable threads 54 on its outer surface for removably connecting to the interengageable threads 16 present on the inner surface of the side wall 14 of the outer cover 13. The connecting feature may also be selected from a group consisting of snap fit, friction fit and the like. Further, it would be within the scope of present disclosure if the side wall 52 is of any other shape selected from a group consisting of non-circular, oval, polygonal shapes and the like.

Further, as shown in FIGS. 5 and 6, the upper portion 52*a* of the side wall 52 has a projection in form of an annular platform 56 on its inner surface proximate to its top end. The annular platform 56 forms a support for the applicator 30. According to other embodiments, the platform 56 may be in form of discontinuous support structures radiating from the inner surface of the upper portion 52*a* of the side wall 52 or any other structure which provides support to the applicator 30.

According to present embodiment, and as shown in FIGS. 5 and 6, in a closed position of the cosmetic case 100, when the cover 10 is connected to the applicator holder 50, a bottom periphery of the side wall 18 of the inner cover 15 is in contact with a top periphery of the upper portion 52*a* of the side wall 52 of the applicator holder 50 providing an airtight seal to the cosmetic case 100. As seen in FIG. 6, the bottom periphery of the side wall 18 of the inner cover 15 has a projection 18*b* running along its entire perimeter and makes an airtight contact with the top periphery of the upper portion 52*a* of the side wall 52 of the applicator holder 50.

Further, in the closed position of the cosmetic case 100, when the cover 10 is connected to the applicator holder 50, a bottom periphery of the side wall 14 of the outer cover 13 is in close proximity with a top periphery of the lower portion 52*b* of the side wall 52 i.e. the shoulder 52*c* (shown in FIG. 7) of the applicator holder 50.

As shown in FIG. 4, the sub-assembly 70 for holding the mesh screen 40 is present between the applicator holder 50 and the pan holder 60. Further, as shown in FIG. 7, the sub-assembly 70 comprises a mesh holder 80, the mesh 40 and a stopper 82.

As shown in FIGS. 6 and 7, the mesh holder 80 comprises a side wall 83 cylindrical in shape forming a housing 84 having an open top end and an open bottom end. Further, it would be within the scope of present disclosure if the side wall 83 is of any other shape selected from a group consisting of non-circular, oval, polygonal shapes and the like. The side wall 83 comprises an upper portion 83*a* and a lower portion 83*b* such that the upper portion 83*a* is step back from the lower portion 83*b* forming a shoulder 83*c*. The mesh screen 40 is placed on a top peripheral surface 85 of the upper portion 83*a* of the side wall 83 such that the mesh screen 40 closes the top end of the housing 84 and a portion of the mesh screen 40 hangs from the top end of the housing 84 on the outer surface of the upper portion 83*a* of the side wall 83. In other words, a portion of the upper portion 83*a* of the side wall 83 is encased by the mesh 40. The stopper 82 is arranged on the outer surface of the upper portion 83*a* such that the portion of the mesh screen 40 hanging from the top end of the side wall 83 is held tight enough between the stopper 82 and the upper portion 83*a* of the side wall 83 of the mesh holder 80, so that the mesh screen 40 does not disengage from the mesh holder 80 on application of pressure by a user.

According to an embodiment, the stopper 82 is snap fitted on the outer surface of the upper portion 83*a* by means of protrusions 82*a* and 82*b* present on an inner surface of the stopper 82 which engage with corresponding grooves 86*a* and 86*b* respectively on an outer surface of the upper portion 83*a* of the side wall 83. According to other embodiments, the stopper 82 can be connected to the upper portion 83*a* by other engagement means selected from a group consisting of threaded engagement, friction fit and the like. Further, a lower surface of the annular projection 56 of the applicator holder 50 has at least one teeth 57 extending in downward direction and the top peripheral surface 85 of the upper portion 83*a* of the side wall 83 has at least one teeth 58 extending in upward direction to further lock the mesh screen 40 between the mesh holder 80 and the applicator holder 50.

Further, as shown in FIGS. 6 and 7, the sub assembly 70 is connected to the applicator holder 50 by suitable engagement means selected from a group consisting of threaded engagement, snap fit, friction fit and the like. According to the present embodiment, the mesh holder 80 is snap fitted to the applicator holder 50. The mesh holder 80 has a projection 87*a* on an outer surface of the lower portion 83*b* of the side wall 83 which engages with a corresponding groove 87*b* on an inner surface of the lower portion 52*b* of the side wall 52 of the applicator holder 50. Further, a sealing ring 89 is provided in the space between the side wall 52 of the applicator holder 50 and the side wall 83 of the mesh holder 80.

Further, as shown in FIGS. 6 and 7, the pan holder 60 holding a cosmetic pan 90 is received inside the housing 84 of the sub assembly 70, and is connected to the sub assembly 70 holding the mesh screen 40 in such a way that a cosmetic (not shown) stored in the cosmetic pan 90 can be dispensed through the mesh screen 40 by application of pressure. The screen covered cosmetic pan 90 is suitable for use with powders, rouges, but particularly with heavy liquid, oil or paste-type compositions such as foundation make-ups, rouge, concealer, eye color, etc. The fine mesh screen 40 enables controlled application of cosmetic to the applicator 30 thus protecting against waste. The mesh screen 40 is of such a consistency that it may be easily depressed with application of slight pressure by hand of the user, thus following the decreasing levels of cosmetic in the cosmetic pan 90 as it is used up. The separate storage of the applicator 30 provided by the applicator holder 50 keeps the applicator 30 away from resting on the mesh screen 40. The applicator 30 thus remains cleaner and is less likely to soil hands and clothes. Further, the mesh screen 40 is made from a fabric which possesses antimicrobial, particularly antibacterial properties. Preferably, the mesh screen 40 comprises silver plated knitted fabric. The fabric may comprise a mixture of polyamide yarn and a polyurethane yarn. The polyurethane yarn may be selected from a group consisting of dorlastan, lycra, spandex, elastin (e.g., elastane) and the like. The polyamide yarn is selected from a group consisting of elastil, nylon, kevlar, poliamid and the like. Preferably, the fabric comprises a mixture of 85-94% polyamide yarn and 5-15% dorlastan. More preferably, the fabric comprises a mixture of 94% polyamide yarn and 6% dorlastan. The coating of silver provides antimicrobial, particularly antibacterial properties which reduces or prevents growth of microbes like bacteria on the mesh screen 40.

The pan holder 60 holding the cosmetic pan 90 is connected to the sub assembly 70 holding the mesh screen 40 by suitable engagement means selected from a group consisting of threaded engagement, snap fit, friction fit and the like. According to the present embodiment, the pan holder 60 comprises a side wall 62 and a bottom wall 64. A lower portion of the side wall 62 comprises a groove 63 on its outer surface which engages with a corresponding projection 88 present on an inner surface of a lower portion of the side wall 83 of the mesh holder 80. The cosmetic pan 90 is generally made of a metal material such as aluminum or plastic or any other material known in art.

Although the foregoing is directed to embodiments of the present disclosure, other and further embodiments of the disclosure may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. A cosmetic case comprising:

a cover and a base assembly, wherein the base assembly includes a cosmetic pan and a mesh screen including anti-microbial properties;

wherein a cosmetic stored in the cosmetic pan can be dispensed through the mesh screen by application of pressure on the mesh screen;

wherein the mesh screen comprises a silver coated knitted fabric; and wherein the silver coated knitted fabric comprises a mixture of polyamide yarn and a polyurethane yarn.

2. The cosmetic case of claim 1, wherein the silver coated knitted fabric comprises 85-94% polyamide yarn and 5-15% polyurethane yarn.

3. The cosmetic case of claim 2, wherein the polyurethane yarn comprised of polyether-polyurea copolymer; and wherein the polyamide yarn is selected from a group consisting of elastil, nylon, kevlar, and poliamid.

4. The cosmetic case of claim 1, wherein the silver coated knitted fabric comprises 94% polyamide yarn and 6% polyether-polyurea copolymer.

5. The cosmetic case of claim 1, wherein the base assembly further comprises an applicator holder, a sub-assembly for holding the mesh screen, and a pan holder for holding the cosmetic pan.

6. The cosmetic case of claim 5, wherein the sub-assembly for holding the mesh screen is present between the applicator holder and the pan holder; and wherein the sub-assembly comprises a mesh holder, the mesh screen and a stopper.

7. The cosmetic case of claim 6, wherein the mesh holder comprises a side wall forming a housing having an open top end and an open bottom end; and wherein the side wall comprises an upper portion and a lower portion such that the upper portion is a step back from the lower portion forming a shoulder between the lower portion and the upper portion.

8. The cosmetic case of claim 7, wherein the mesh screen is placed on a top peripheral surface of the upper portion of the side wall of the mesh holder such that the mesh screen closes the open top end of the housing of the mesh holder and a portion of mesh screen hangs from the open top end on an outer surface of the upper portion of the side wall of the mesh holder.

9. The cosmetic case of claim 8, wherein the stopper is arranged on the outer surface of the upper portion of the mesh holder such that the portion of the mesh screen hanging from the open top end of the side wall of the mesh holder is held tight enough between the stopper and the upper portion of the side wall of the mesh holder.

10. The cosmetic case of claim 9, wherein the stopper is snap fitted on the outer surface of the upper portion of the mesh holder by means of protrusions present on an inner surface of the stopper which engages with corresponding grooves respectively on the outer surface of the upper portion of the side wall of the mesh holder.

11. The cosmetic case of claim 10, wherein the applicator holder comprises a side wall forming a housing having an open top end and an open bottom end; and wherein the side wall comprises a lower portion and an upper portion that is a step back from the lower portion forming a shoulder between the lower portion and the upper portion.

12. The cosmetic case of claim 11, wherein the upper portion of the side wall of the applicator holder has a projection in form of an annular platform for supporting an applicator; and wherein a lower surface of the annular platform of the applicator holder has at least one teeth extending in downward direction and a top peripheral surface of the upper portion of the side wall of the mesh holder has at least one teeth extending in upward direction to further lock the mesh screen between the mesh holder and the applicator holder.

13. The cosmetic case of claim 12, wherein the mesh holder is snap fitted to the applicator holder, and wherein the mesh holder has a projection on the outer surface of the lower portion of the side wall of the mesh holder which engages with a corresponding groove on an inner surface of the lower portion of the side wall of the applicator holder.

14. The cosmetic case of claim 13, wherein a sealing ring is provided in a space between the side wall of the applicator holder and the side wall of the mesh holder.

15. The cosmetic case of claim 14, wherein the cover comprises an outer cover and an inner cover, the inner cover comprising a top wall and a side wall; and wherein in a closed position of the cosmetic case, a bottom periphery of the side wall of the inner cover contacts a top periphery of the upper portion of the side wall of the applicator holder for providing an airtight seal to the cosmetic case.

16. The cosmetic case of claim 15, wherein in the closed position of the cosmetic case, a bottom periphery of the outer cover is in close proximity with a top periphery of the lower portion of the side wall of the applicator holder.

17. A cosmetic case comprising:

a base assembly, a cover configured to be removably coupled to the base assembly;

wherein the base assembly comprises an applicator holder, a sub assembly for holding a mesh screen; and a pan holder for holding a cosmetic pan;

wherein the sub-assembly for holding the mesh screen is present between the applicator holder and the pan holder;

wherein the sub-assembly comprises a mesh holder, the mesh screen and a stopper;

wherein the mesh holder comprises a side wall forming a housing having an open top end and an open bottom end;

wherein the side wall of the mesh holder comprises an upper portion and a lower portion such that the upper portion is a step back from the lower portion forming a shoulder between the upper portion and the lower portion;

wherein the mesh screen covers the open top end of the housing and at least a portion of an outer surface of the side wall of the mesh holder;

wherein the stopper is arranged on an outer most diameter surface of the upper portion of the mesh holder such that the mesh screen is held tight between the stopper and the upper portion of the side wall of the mesh holder;

wherein the mesh holder has a projection on thean outer surface of the lower portion of the side wall which engages with a corresponding groove on an inner surface of a lower portion of a side wall of the applicator holder;

wherein an upper portion of the side wall of the applicator holder has a projection in form of an annular platform for supporting an applicator; and wherein a lower surface of the annular platform of the applicator holder has at least one teeth extending in downward direction and a top peripheral surface of the upper portion of the side wall of the mesh holder has at least one teeth extending in upward direction to further lock the mesh screen between the mesh holder and the applicator holder.

18. The cosmetic case of claim 17, wherein the cover comprises an outer cover and an inner cover, the inner cover comprising a top wall and a side wall; and wherein the applicator holder comprises a side wall forming a housing having an open top end and a bottom end; and wherein the side wall of the applicator holder comprises a lower portion and an upper portion that is a step back from the lower portion.

19. The cosmetic case of claim 18, wherein in a closed position of the cosmetic case, a bottom periphery of the side wall of the inner cover contacts a top periphery of the upper portion of the side wall of the applicator holder for providing an airtight seal to the cosmetic case; and wherein in closed position of the cosmetic case, a bottom periphery of the outer cover is in close proximity with a top periphery of the lower portion of the side wall of the applicator holder.

20. A cosmetic case comprising:

a base assembly, a cover configured to be removably coupled to the base assembly;

wherein base assembly comprises an applicator holder, a sub-assembly for holding a mesh screen; and a pan holder for holding a cosmetic pan;

wherein the sub-assembly is present between the applicator holder and the pan holder;

wherein the sub-assembly comprises a mesh holder, a mesh screen and a stopper;

wherein the mesh holder comprises a side wall forming a housing having an open top end and a bottom end and wherein the side wall comprises an upper portion and a lower portion;

wherein the mesh screen covers the open top end of the housing and at least a portion of an outer surface of the side wall of the mesh holder;

wherein the stopper is arranged on an outer most diameter surface of the upper portion of the mesh holder such that the mesh screen is held tight between the stopper and the upper portion of the side wall of the mesh holder;

wherein the mesh holder has a projection on an outer surface of a lower portion of the side wall which engages with a corresponding groove on an inner surface of a lower portion of a side wall of the applicator holder;

wherein an upper portion of the side wall of the applicator holder has a projection in form of an annular platform for supporting an applicator; and wherein a lower surface of the annular platform of the applicator holder has at least one teeth extending in downward direction and a top peripheral surface of the upper portion of the side wall of the mesh holder has at least one teeth extending in upward direction to further lock the mesh screen between the mesh holder and the applicator holder;

wherein the mesh screen comprises a silver coated knitted fabric; and wherein the silver coated knitted fabric comprises a mixture of polyamide yarn and a polyurethane yarn.

* * * * *